US010840606B2

(12) United States Patent
Cohen

(10) Patent No.: US 10,840,606 B2
(45) **Date of Patent: *Nov. 17, 2020**

(54) MILLIMETRIC FRACTAL PLASMONIC ARRAYS

(71) Applicant: FRACTAL ANTENNA SYSTEMS, INC., Bedford, MA (US)

(72) Inventor: Nathan Cohen, Belmont, MA (US)

(73) Assignee: Fractal Antenna Systems, Inc., Bedford, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/815,221

(22) Filed: Nov. 16, 2017

(65) Prior Publication Data

US 2018/0138576 A1 May 17, 2018

Related U.S. Application Data

(60) Provisional application No. 62/422,986, filed on Nov. 16, 2016.

(51) Int. Cl.

| | |
|---|---|
| ***H01Q 1/22*** | (2006.01) |
| ***H01Q 21/06*** | (2006.01) |
| ***H01Q 15/00*** | (2006.01) |
| ***H01Q 1/38*** | (2006.01) |
| *H01Q 3/36* | (2006.01) |

(52) U.S. Cl.

CPC ..... *H01Q 21/061* (2013.01); *H01Q 1/22* (2013.01); *H01Q 1/38* (2013.01); *H01Q 15/0093* (2013.01); *H01Q 3/36* (2013.01)

(58) Field of Classification Search

CPC ..... H01Q 1/22; H01Q 1/38; H01Q 15/0093; H01Q 21/061

See application file for complete search history.

(56) References Cited

U.S. PATENT DOCUMENTS

| | | | | |
|---|---|---|---|---|
| 4,987,424 | A * | 1/1991 | Tamura | H01Q 1/085 343/795 |
| 9,035,849 | B2 * | 5/2015 | Cohen | H01L 31/042 343/899 |
| 9,134,465 | B1 * | 9/2015 | Cohen | G02B 5/008 |
| 9,482,474 | B2 * | 11/2016 | Cohen | F28F 7/00 |
| 10,027,033 | B2 * | 7/2018 | Cohen | H01Q 15/0093 |
| 10,415,896 | B2 * | 9/2019 | Cohen | F28F 7/00 |
| 2003/0034926 | A1 * | 2/2003 | Veerasamy | H01Q 1/1271 343/713 |
| 2003/0151556 | A1 * | 8/2003 | Cohen | H01Q 1/243 343/700 MS |

(Continued)

OTHER PUBLICATIONS

Patil et al.; "Multiband Smart Fractal Antenna Design for Converged 5G Wireless Networks"; 2015 International Conference on Pervasive Computing (ICPC); Jan. 8-10, 2015; (Year: 2015).*

(Continued)

*Primary Examiner* — Ab Salam Alkassim, Jr.

(74) *Attorney, Agent, or Firm* — Cesari and McKenna, LLP

(57) ABSTRACT

Fractal plasmonic arrays are described that operate at millimeter-based wavelengths and that include a thin-film sheet, preferably optically transparent or optically translucent, attached either on the inside or outside of a window or laminated in layers within, adjacent to, or outside a window.

6 Claims, 3 Drawing Sheets

(56) References Cited

U.S. PATENT DOCUMENTS

| | | | | |
|---|---|---|---|---|
| 2008/0024304 | A1* | 1/2008 | Bergman | G06K 7/10316 340/572.7 |
| 2008/0180331 | A1* | 7/2008 | Brady | H01Q 1/1271 343/705 |
| 2012/0119972 | A1* | 5/2012 | Borlee | H01Q 1/40 343/873 |
| 2014/0090828 | A1* | 4/2014 | Cohen | H02J 50/40 165/185 |
| 2014/0182811 | A1* | 7/2014 | Hager | H01Q 1/02 165/47 |
| 2017/0061176 | A1* | 3/2017 | Cohen | G06K 7/10366 |
| 2017/0111024 | A1* | 4/2017 | Nathan | H01Q 15/0093 |
| 2019/0128624 | A1* | 5/2019 | Cohen | H01Q 13/02 |
| 2019/0146082 | A1* | 5/2019 | Cohen | G01S 13/931 |
| 2019/0162486 | A1* | 5/2019 | Cohen | H02J 50/12 |
| 2019/0204027 | A1* | 7/2019 | Cohen | F25B 39/00 |

OTHER PUBLICATIONS

Kumar et al.; "Micro strip Fractal Linear Array for Multiband Applications"; 2014 IEEE International Conference on Advanced Communication Control and Computing Technologies (ICACCCT); May 8-10, 2014; (Year: 2014).*

* cited by examiner

MILLIMETRIC FRACTAL PLASMONIC ARRAYS

CROSS-REFERENCE TO RELATED APPLICATION

This application is based upon and claims priority to U.S. provisional patent application 62/422,986, entitled "Millimetric Fractal Plasmonic Arrays," filed 16 Nov. 2016. The entire content of this application is incorporated herein by reference.

BACKGROUND

Antenna needs are dictated by the environment, frequency range and carrying capacity of the wireless systems which they enable. A compelling example of this is currently planned 5G cell/data services, in which messages will be sent over vast bandwidths at mm wavelengths, for example 50 GHz or 60 GHz frequencies.

These '5G' bands have merit in that they can carry a huge number of messages because of the large bandwidth, albeit relatively small as a fractional value of the band's frequency. By going to such high frequencies, the profile of the directional antennas sought to enable the 5G systems is small because of the short wavelengths used.

The prior art utilizes a variety of directional antennas to produce high gain 'panel' antennas. The problem with such systems is their inability to leverage the smaller size and placement that going to these higher frequency affords.

An example of the need for a better solution lies with the user scenario of incorporating 5G cells or 5G small cells in buildings. They must be numerous because of the link budget degradation that occurs at higher frequencies, but placing them may be problematic. A viable solution is to place these 5G cell sites adjacent to or on windows, such as in office buildings or other multiple tenant buildings which are window-dominated. However, their overall form factor, complicated by a feed system, makes them unacceptable as a window 'add on' in buildings. Additionally an unobtrusive system is necessary for placement on walls, doors, or other structure.

SUMMARY

An aspect of the present disclosure is directed to millimetric fractal plasmonic arrays that include a thin-film sheet, preferably optically transparent or optically translucent, attached either on the inside or outside of a window or laminated in layers within, adjacent to, or outside a window. Such a window may, for example, be located on a commercial building, an apartment building, or a municipal building, or a vehicle such as a car, truck, train, watercraft, submarine, satellite, and the like.

These, as well as other components, steps, features, objects, benefits, and advantages, will now become clear from a review of the following detailed description and the accompanying drawing.

BRIEF DESCRIPTION OF DRAWINGS

The drawings are of illustrative embodiments. They do not illustrate all embodiments. Other embodiments may be used in addition or instead. Details that may be apparent or unnecessary may be omitted to save space or for more effective illustration. Some embodiments may be practiced with additional components or steps and/or without all of the components or steps that are illustrated. When the same numeral appears in different drawings, it refers to the same or like components or steps.

DETAILED DESCRIPTION OF ILLUSTRATIVE EMBODIMENTS

Figure 1:
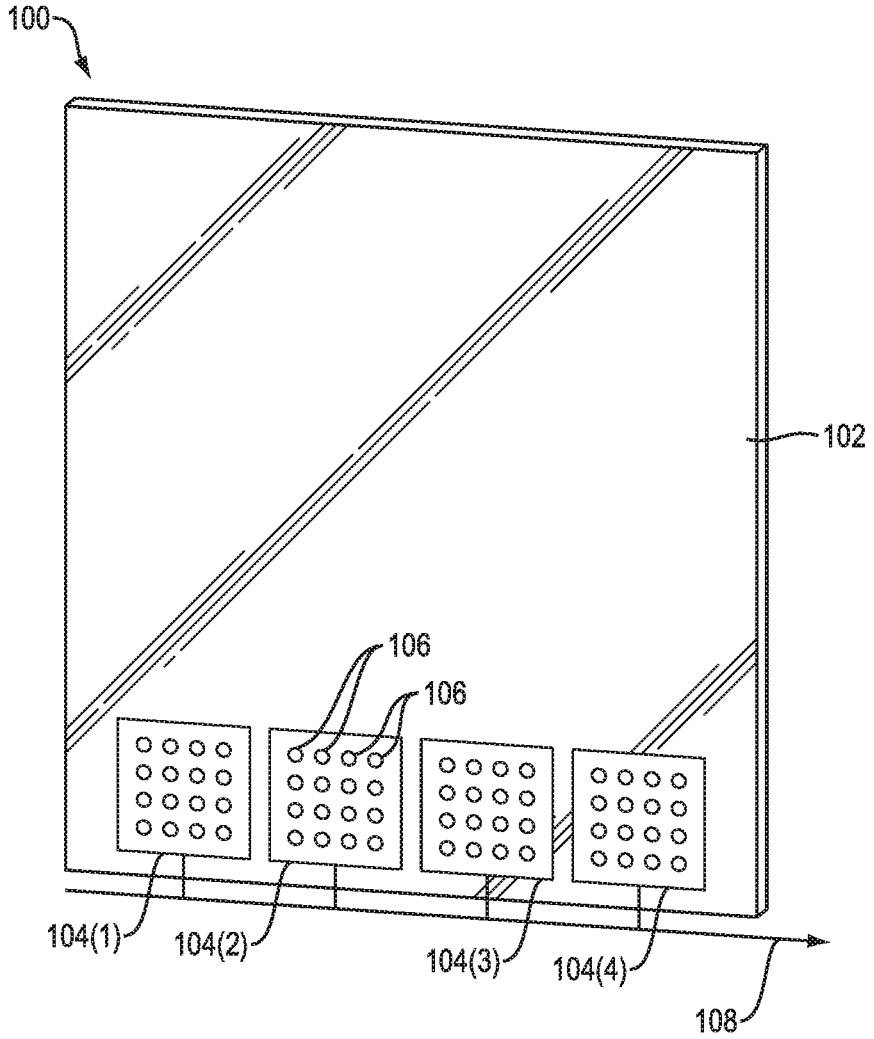
FIG. 1 depicts an exemplary embodiment of a millimetric fractal plasmonic array system in accordance with the present disclosure.

Illustrative embodiments are now described. Other embodiments may be used in addition or instead. Details that may be apparent or unnecessary may be omitted to save space or for a more effective presentation. Some embodiments may be practiced with additional components or steps and/or without all of the components or steps that are described.

To address issues noted above for the prior state of the art, aspects and embodiments of the present disclosure provide a low profile antenna array, preferably including (but not limited to) a transparent or translucent antenna array, with an unobtrusive feed system that can be placed on an existing window or other structure yet be non-invasive, physically and/or aesthetically, to users and to occupants of the adjacent (e.g., floor) space shared with the window.

Embodiments of the present disclosure incorporate an array of fractal antenna elements configured as a close spaced array in a "fractal plasmonic surface" or FPS. The term "fractal" is meant here as incorporating at least one shape which is at least, in part, described as a substantially self-similar fractal with at least two iterations of application of a generator motif. This description will be the working definition of 'fractal' as used below.

A FPS is a metamaterial array of fractal material or fractal shape(s). It can include a thin sheet of substrate that has a close packed grid like array of conductive fractal elements, which are disposed to each other very closely (~<⅛ wavelength) but are not directly connected to each other, nor (save for below) to any feed system. The fractal elements may excite each other electromagnetically through evanescent waves.

Such an array, so disposed on the substrate, may look transparent or translucent in appearance, and this may be accomplished by a thin deposition on the substrate of a silver layer, that is removed or selectively deposited in appropriate locations to render conductive traces. Any suitable material can be used for the conductive traces, e.g., copper, gold, or silver, or conductive inks, conductive plastics (e.g., PMMA with conductive silver particles, etc.), or indeed any suitable conductive material, with PMMA referring to polymethyl methacrylate, also known as acrylic or acrylic glass as well as by the trade names Plexiglas, Acrylite, Lucite, and Perspex among several others.

An array used in accordance with the present disclosure can be fed through connection to elements on one or more sides or edges, thus reducing the actual connections to locations less obtrusive to the appearance of the array. The invention may appear as an unobtrusive 'patch' that is see-through and does not prevent or decrease the use of the window as an aesthetic device.

Exemplary embodiments of the present disclosure are configured for operation at "millimetric" wavelengths and corresponding frequencies, with such wavelengths indicating or connoting wavelengths that are on the order of one or more millimeters (including a portion of one millimeter) or multiple millimeters.

In exemplary embodiments, an array can be beam steered by selective control of the phasing of the feeds (so specified on the sides and/or edges). Such phasing (outside of the application to FPS and millemetric arrays) is well-known in the art.

Exemplary embodiments of the present disclosure can provide a feed system and/or a suitable transceiver attached to a millimetric array as a combined system.

In exemplary embodiments of the present disclosure, millimetric fractal plasmonic arrays may comprise a thin-film sheet, preferably optically transparent or optically translucent, attached either on the inside or outside of a window or laminated in layers within or outside a window. Said window may for example be located on a commercial building, an apartment building, or a municipal building.

FIG. 1 depicts an exemplary embodiment of a millimetric fractal plasmonic array system 100 in accordance with the present disclosure. The system 100 can include a pane or window 102, which can be made of suitable transparent or even translucent material. The system 100 can include a portion having a fractal plasmonic surface (FPS), which as shown, can include a number of fractal plasmonic surface (FPS) sub-arrays 104(1)-104(N), with four such sub-arrays being shown for non-limiting example. A FPS can be disposed on a supporting surface. For example, the supporting surface can include a glass or plastic wall, a glass or plastic partition, a glass or plastic door, a light fixture incorporating glass or plastic, a portion of a street light, a portion of a disposal canister incorporating glass or plastic, or an item of furniture incorporating glass or plastic. In exemplary embodiments, the FPS can be disposed on or in a thin-film sheet or material (not shown). Each sub-array 104(1)-104(N), includes a number of fractal cells 106, which can have the same or different fractal-based shapes, as described in further detail below. The sub-arrays can be fed by feedlines, which can be incorporated into a phase delay line 108 as shown.

In exemplary embodiments, a thin-film sheet can have a coating of very thin conductor (conductive material) which allows for the transparency. This conductive coating is preferably formed, etched, or ablated so as to make one or more arrays of fractal plasmonic surfaces. The fractal plasmonic surfaces can include arrays and sub-arrays of fractal resonators that are close-coupled, e.g., within proximity of one another (but not directly touching) by a distance of the less than a wavelength (of operation such as at 5G bands at 5 GHz) and preferably less than approximately or about ½, ¼, ⅕, ⅙, ⅛, or 1/10 of a wavelength (lambda, λ). Such close coupling can provide or facilitate plasmonic or evanescent-wave coupling or energy transfer. For example at a given frequency band, the resonators may be positioned within approximately or about ½, ¼, ⅙, ⅛, or 1/10 of a wavelength (lambda, λ) at the highest frequency of the range. Of course other wavelengths corresponding to frequencies within the range may be used. The fractal plasmonic surfaces are preferably made to resonate at millimetric (millimeter) wavelengths so as to constitute an adaptive receive and/or transmit antenna that can be used for example for 5G cellular and data communications (e.g., according to the IEEE 802.11ac standard at 5 GHz); the fractal plasmonic surfaces can be made to and can operate at other frequency bands and according to other standards such as those including but not limited to IEEE 802.11n (at GHz and/or 24 GHz), 4G/IMT/LTE, and other well-known standards.

Each of the resonators of the arrays and/or sub-arrays are preferably closed fractal-based conductive traces or lines; such fractal-based features can be fractalized as $2^{nd}$, $3^{rd}$, $4^{th}$, or higher (N) iterations (or, orders) based on an underlying fractal generator or motif. Other shapes may be used instead or addition to the fractal-based features.

Figure 2:
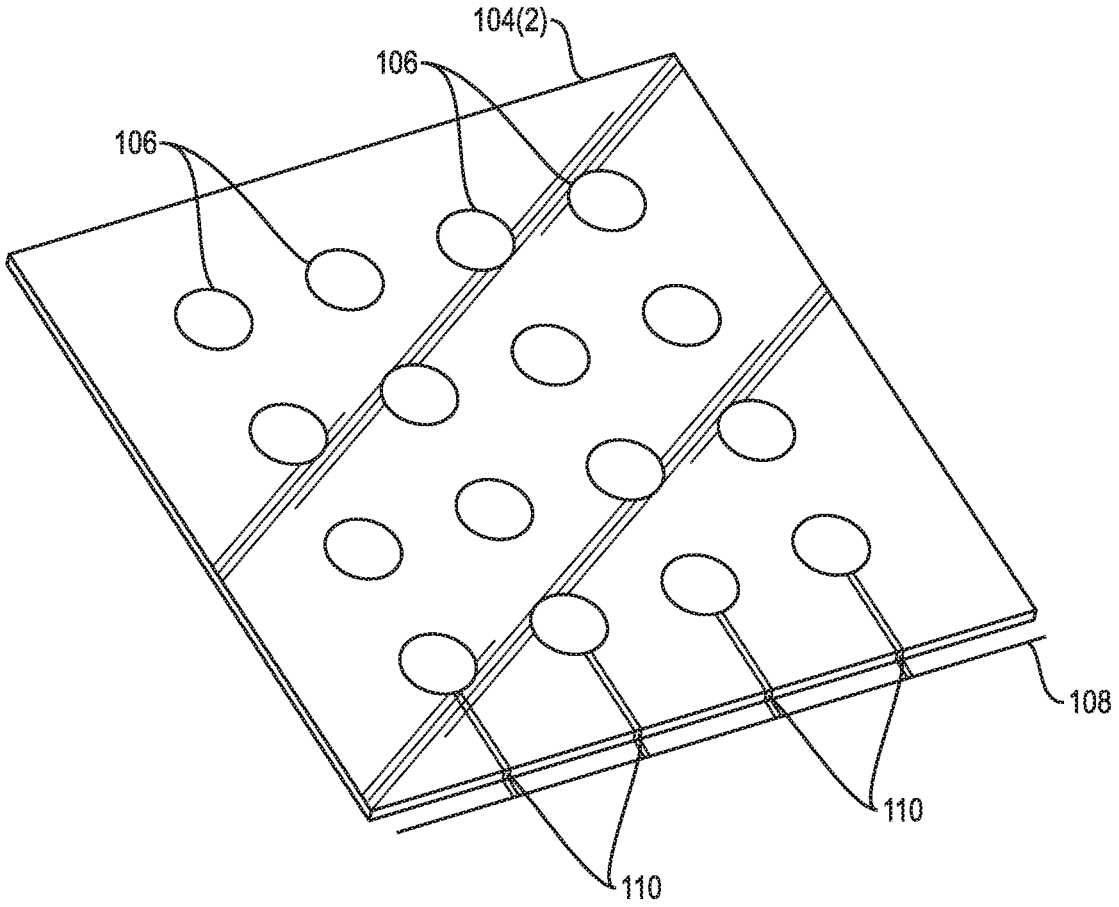
FIG. 2 depicts an enlarged portion of the embodiment shown for FIG. 1.

FIG. 2 depicts an enlarged portion of the embodiment shown for FIG. 1. As shown, fractal plasmonic surface sub-array 104(2) includes a number (e.g., 16) of fractal resonator cells, which are fed by a number of feed connectors 110 that are part of phase delay line 108.

Figure 3:
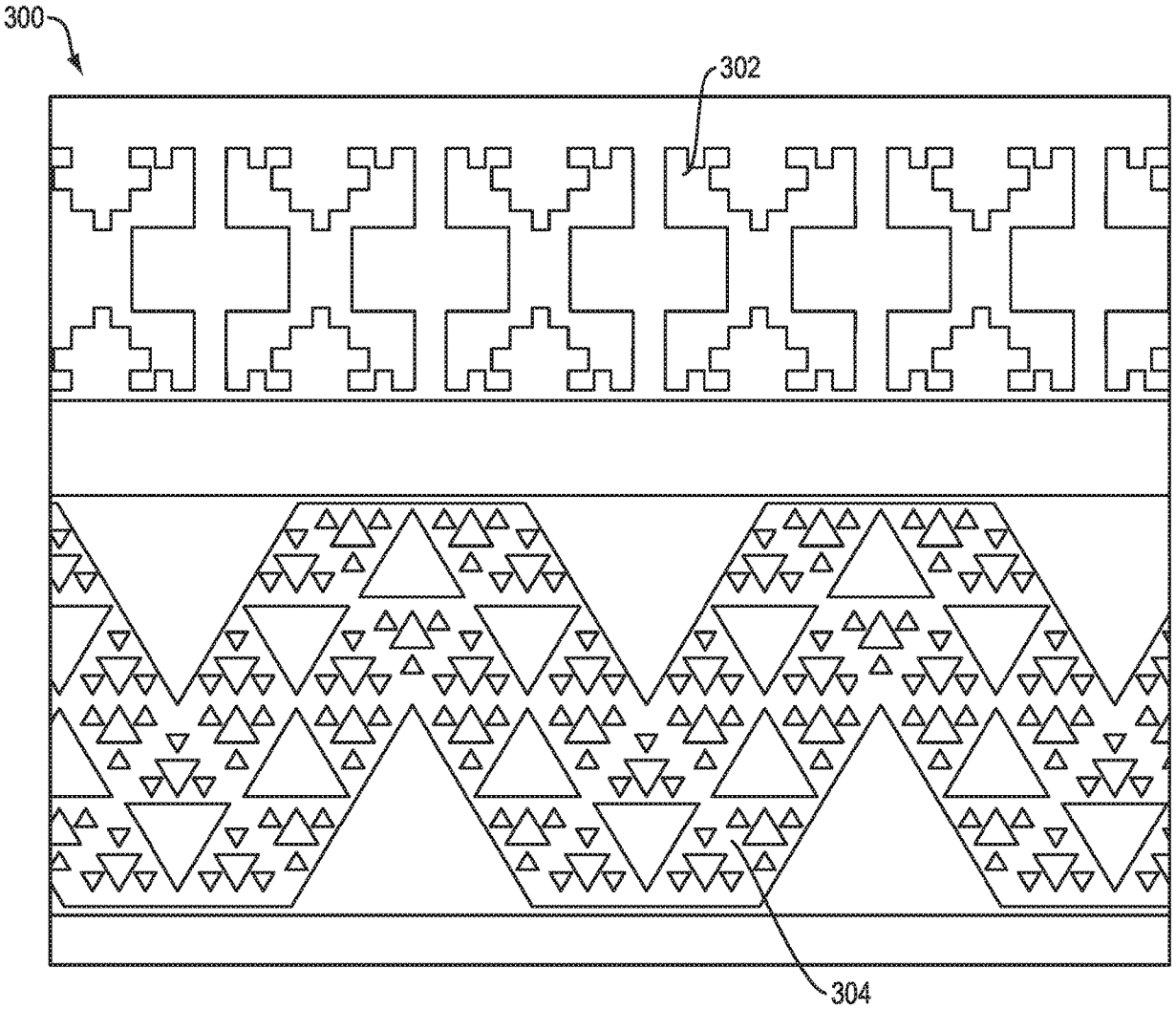
FIG. 3 depicts exemplary shapes of array elements useful for embodiments of the present disclosure.

FIG. 3 depicts a set 300 of exemplary shapes of array elements useful for embodiments of the present disclosure. As shown at the top, exemplary shapes for each resonator can include a fractalized four-lobe shape (e.g., similar to a four-leaf clover or a four-lobe snow flake). As shown at the bottom of the figure, other suitable resonator shapes include Sierpinski-based triangles such as but not limited to those shown in the depicted serpentine band of a Sierpinski gasket. Other examples of suitable fractal shapes and generators that can be used include but are not limited to circular, elliptical, triangular, rectangular, and split-ring shapes, including split-ring resonators.

In one embodiment a plurality of fractal plasmonic surfaces, so etched, ablated, or deposited, are connected as to constitute a directional array. The directional array can be controlled by powering each separate surface in the array, with separate phase delays. Thus the overall array is composed of a unique and novel set of sub arrays that act as a whole as an antenna. The phase delays may be changed, thereby allowing beam steering of the overall array.

It will be noted that the fractal millimetric plasmonic arrays constitute a novel means of incorporating a nearly invisible cell site taking advantage of a dominant component of buildings, that is to say windows. In contrast existing cell sites utilize towers and or attached large arrays thereby producing both physical and aesthetic issues. It will be appreciated that this invention allows for a nearly imperceptible cell site that is capable of working at 5G frequency allocations (or others).

The components, steps, features, objects, benefits, and advantages that have been discussed are merely illustrative. None of them, or the discussions relating to them, is intended to limit the scope of protection in any way. Numerous other embodiments are also contemplated. These include embodiments that have fewer, additional, and/or different components, steps, features, objects, benefits, and/or advantages. These also include embodiments in which the components and/or steps are arranged and/or ordered differently.

For example, while Sierpinski triangles and four-lobed features are shown in FIG. 3, fractal shapes according to the present disclosure can include any suitable fractal shapes.

Unless otherwise stated, all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain.

All articles, patents, patent applications, and other publications that have been cited in this disclosure are incorporated herein by reference.

The phrase "means for" when used in a claim is intended to and should be interpreted to embrace the corresponding structures and materials that have been described and their equivalents. Similarly, the phrase "step for" when used in a claim is intended to and should be interpreted to embrace the corresponding acts that have been described and their equivalents. The absence of these phrases from a claim means that the claim is not intended to and should not be interpreted to be limited to these corresponding structures, materials, or acts, or to their equivalents.

The scope of protection is limited solely by the claims that now follow. That scope is intended and should be interpreted to be as broad as is consistent with the ordinary meaning of the language that is used in the claims when interpreted in light of this specification and the prosecution history that follows, except where specific meanings have been set forth, and to encompass all structural and functional equivalents.

Relational terms such as "first" and "second" and the like may be used solely to distinguish one entity or action from another, without necessarily requiring or implying any actual relationship or order between them. The terms "comprises," "comprising," and any other variation thereof when used in connection with a list of elements in the specification or claims are intended to indicate that the list is not exclusive and that other elements may be included. Similarly, an element proceeded by an "a" or an "an" does not, without further constraints, preclude the existence of additional elements of the identical type.

None of the claims are intended to embrace subject matter that fails to satisfy the requirement of Sections 101, 102, or 103 of the Patent Act, nor should they be interpreted in such a way. Any unintended coverage of such subject matter is hereby disclaimed. Except as just stated in this paragraph, nothing that has been stated or illustrated is intended or should be interpreted to cause a dedication of any component, step, feature, object, benefit, advantage, or equivalent to the public, regardless of whether it is or is not recited in the claims.

The abstract is provided to help the reader quickly ascertain the nature of the technical disclosure. It is submitted with the understanding that it will not be used to interpret or limit the scope or meaning of the claims. In addition, various features in the foregoing detailed description are grouped together in various embodiments to streamline the disclosure. This method of disclosure should not be interpreted as requiring claimed embodiments to require more features than are expressly recited in each claim. Rather, as the following claims reflect, inventive subject matter lies in less than all features of a single disclosed embodiment. Thus, the following claims are hereby incorporated into the detailed description, with each claim standing on its own as separately claimed subject matter.

What is claimed is:

1. An antenna system comprising:

a two-dimensional (2D) array of close-spaced fractal elements configured as a fractal plasmonic surface operational at a set of frequencies within the allotted 5G cell bands at millimetric wavelengths, wherein adjacent fractal elements are spaced in proximity to one another less than ⅛ of a wavelength of an operational wavelength of the system and support plasmonic wave energy transfer between the fractal elements;

wherein the fractal elements are not directly connected to one another;

wherein the array is disposed on a supporting surface;

wherein the fractal plasmonic surface is configured as a number N of sub-arrays; and N feedlines, wherein each feedline is connected to and operative to feed a respective one of the N sub-arrays.

2. The antenna system of claim 1, wherein the surface comprises a window.

3. The antenna system of claim 1, where the surface comprises a supporting structure incorporating glass or plastic.

4. The antenna system of claim 1, wherein the array comprises a translucent or transparent conductive layer on a translucent or transparent substrate.

5. The antenna system of claim 1, wherein each feedline is connected to a respective sub-array at individual fractal elements in separate columns along one side of the sub-array.

6. The antenna system of claim 5, wherein the feedlines are incorporated into a phase delay line, wherein each sub-array is operative for beam-steering.

* * * * *